United States Patent [19]

Ursprung

[11] Patent Number: 4,781,482

[45] Date of Patent: Nov. 1, 1988

[54] GLUE GUN WITH RACK AND PINION FEEDER

[75] Inventor: Reinhard Ursprung, Eching, Fed. Rep. of Germany

[73] Assignee: Test-Rite Products Corp., Clifton, N.J.

[21] Appl. No.: 51,847

[22] Filed: May 18, 1987

[30] Foreign Application Priority Data

May 16, 1986 [DE] Fed. Rep. of Germany ... 8613376[U]

[51] Int. Cl.[4] ..... B05C 5/04

[52] U.S. Cl. ..... 401/1; 401/66; 219/229; 222/146.5; 222/391

[58] Field of Search ..... 401/1, 2, 3, 66; 219/229, 230, 238; 228/52, 53; 222/146.5, 389, 391; 220/4 E; 186/284

[56] References Cited

U.S. PATENT DOCUMENTS

| | | | |
|---|---|---|---|
| 2,742,142 | 4/1956 | Paulsen | 222/146.5 X |
| 2,995,159 | 8/1961 | Berggren | 222/146.5 X |
| 3,077,281 | 2/1963 | Braverman | 220/4 E X |
| 3,281,576 | 10/1966 | Cooper et al. | 228/53 X |
| 3,596,695 | 8/1971 | Stevenazzi | 220/4 E X |
| 3,707,258 | 12/1972 | Schlitt | 228/52 |
| 3,800,986 | 4/1974 | Stamp | 222/146.5 |
| 4,034,926 | 7/1977 | Wegner | 220/4 E X |
| 4,379,516 | 4/1983 | Barlogis | 222/146.5 |
| 4,463,877 | 8/1984 | Siwon | 222/146.5 |
| 4,601,597 | 7/1986 | Bertram et al. | 401/2 X |
| 4,637,745 | 1/1987 | Speisebecher et al. | 401/2 X |

FOREIGN PATENT DOCUMENTS

| | | | |
|---|---|---|---|
| 2140875 | 1/1984 | United Kingdom | 401/1 |

*Primary Examiner*—Richard J. Apley
*Assistant Examiner*—David J. Bender
*Attorney, Agent, or Firm*—Natter & Natter

[57] ABSTRACT

A glue gun includes a glue stick feed path, a heating assembly in the feed path and a glue stick feeding system. A trigger includes a gear rack extending along its upper surface and the feeding system further includes a pinion having rim teeth which engage a glue stick positioned in the feed path. The trigger is mounted for movement in a direction substantially parallel to the glue stick feed path axis and drives the pinion to advance the glue stick, when the trigger is squeezed. The trigger includes a pin extending in a guiding channel of the glue gun to permit tilting the rack toward the glue stick feed path. The pinion is mounted in a channel for displacement perpendicular to the feed path axis so that it bears against the glue stick when the trigger is tilted. The pinion may be provided with two rows of rim teeth and a portion of the glue stick periphery may extend into a trough formed between the rows.

13 Claims, 3 Drawing Sheets

GLUE GUN WITH RACK AND PINION FEEDER

FIELD OF THE INVENTION

This invention relates generally to electric glue guns and more particularly to glue stick feeding systems.

BACKGROUND ART

Hot melt adhesives have gained acceptance in both industrial and domestic environments. Hot melt adhesives generally comprised a thermoplastic which was substantially solid at room temperature and which melted when heated. Various thermoplastic adhesive have been developed for different purposes such as gluing calking and sealing. Generally, the thermoplastics become molten and tacky at temperatures ranging from 370° F. to 400° F. (188° C. to 204° C.). When in a molten state, the hot melt adhesives adhered to most surfaces. Among the advantages of hot melt adhesives were that they rapidly set, provided a waterproof bond and were not affected by most solvents.

Hot melt adhesives have been used to bond such surfaces as wood, plastics, foam, cardboard, fabrics, ceramics and paper. They have also been employed as a sealing or caulking material. In addition, they were electronically insulative and have been employed to seal and insulate electronic components.

Glue guns have been employed to melt and extrude hot melt adhesives. For glue gun applications, the thermoplastic hot melts have been formed into cylindrical rods, commonly referred to as glue sticks, which were available in lengths of 2 to 10 inches (5 to 26 cm). The glue guns included a glue feed path having an electric heating element with a cylindrical bore adapted to receive successive glue sticks at its upstream end and an extrusion nozzle at its downstream end.

The user fed glue sticks by hand in occasional use, low cost, glue guns. The danger of accidental injury when using such glue guns, uneven advance stroke and other factors, limited the usage of such guns. Trigger advance mechanisms have been provided for forcing glue sticks into the heating elements in better quality glue guns. Previous trigger advance mechanisms were relatively complex and included levers and claws for engaging the outside of the glue stick.

In the advance mechanism employed, for example, in the No. 216 Bostic Thermogrip glue gun, a trigger was connected to a double lever which engaged a feeder slide. Other trigger advance mechanisms included three or more spring loaded levers with the last lever having a claw which directly engaged the outside of a glue stick. Generally, the trigger advance mechanisms of the past included a relatively high number of complex components resulting in high assembly costs.

An additional disadvantage of prior glue gun trigger advance systems was that due to the nature of the glue stick gripping mechanisms which engaged the outer surface of the glue sticks, the engaging claw or lever had a tendency to impale the glue sticks. This tendency was, in part, due to the softening of the glue stick from the heat generated at the downstream heating element and/or softness of the glue stick itself at ambient temperatures. Penetration of the claw or lever into a glue stick did not result in glue stick advancement.

As a result of the impalement of the claw or lever in the glue sticks, the lever mechanisms became imbedded in the glue sticks which impeded the return of the levers to their original positions when the trigger was released.

Usually, the lever mechanisms included a return spring for retracting the levers upon release of the trigger. Once the levers or claws became embedded into a glue stick, repair involved difficult procedures including possible disassembly of the gun.

In order to reduce the tendency of prior levers or claws becoming impaled in a glue stick, many glue guns included apertures through the glue gun casings. The apertures provided not only for cooling, but in addition, access to the lever mechanism for the purpose of freeing levers or claws which were lodged in the glue stick.

On the other hand, in instances wherein the glue stick surface was relatively hard, an imbalance of lever force components resulted in slippage without positive advancement of the glue stick toward the heating element.

A further problem which has been encountered with prior glue gun feed mechanisms has been the relatively short glue stick advance for a trigger stroke. This was principally due to the operation of the force multiplying lever arrangements. In some instances, a glue stick advance as short as $\frac{3}{8}$ to $\frac{5}{8}$ inch (10 to 15 mm) resulted from a $2\frac{1}{2}$ inch (65 mm) trigger stoke. Such short glue stick advance resulted in relatively short extruded sealing lines for each trigger stroke. In sealing applications, a continuous uninterrupted sealing line was preferred. With relatively short glue stick advances, short sealing lines resulted and a uniform sealing line greater than, for example, 40 mm in length was often impossible.

DISCLOSURE OF THE INVENTION

In compendium, the present invention relates to a glue gun feeding mechanism having a pinion which includes rim teeth engaging the outer surface of a cylindrical glue stick. The pinion is mounted within a glue gun casing for rotation along an axis perpendicular to a glue stick feed path axis. The pinion is journalled within vertical channels of the casing to permit vertical translational movement of the pinion for increasing glue stick engagement pressure and for facilitating disengagement with the glue stick for a trigger return stroke.

A trigger assembly is mounted for reciprocal movement along an axis generally parallel to the glue stick feed path axis and is keyed for horizontal displacement while permitting pivotal movement about its forward end. The upper surface of the trigger includes a gear rack which engages the pinion. Increasing pivotal pressure on the trigger causes the pinion to increase engagement pressure between the pinion teeth and the glue stick.

For positive glue stick pinion engagement, the pinion can include split rows of teeth so that double rim tooth surface engagement is provided with the glue stick.

The glue gun includes a two-part plastic casing adapted for quick assembly through the use of retaining rings and interengaged flukes. In addition, the heating element extrusion nozzle is covered with a silicone rubber heat resistant sheath to reduce the danger of operator injury.

From the foregoing compendium, it will be appreciated that a consideration the present invention is to provide an improved glue gun of the general character described which is not subject to the disadvantages of the prior art aforementioned.

A feature of the present invention is to provide an improved glue gun of the general character described which is low in cost and suitable for economical mass production fabrication.

An aspect of the present invention is to provide a glue gun feeding mechanism of the general character described which is simple in operation and formed with but a modicum of components.

A further consideration of the present invention is to provide a glue gun feeding mechanism of the general character described which is efficient and relatively jam free.

Another consideration of the present invention is to provide a glue gun feeding mechanism of the general character described which produces glue stick advancement without the utilization of levers.

A further aspect of the present invention is to provide a glue gun feeding mechanism of the general character described which employs a rack and pinion drive between a glue gun trigger and a glue stick.

Another consideration of the present invention is to provide a glue gun feeding mechanism of the general character described which is capable of exerting variable gripping force upon a glue stick.

An additional feature of the present invention is to provide a glue gun feeding mechanism of the general character described capable of producing uninterrupted extrusions of extended length with a single trigger stroke.

Another aspect of the present invention is to provide a glue gun feeding mechanism of the general character described capable of assembly by relatively unskilled personnel.

An additional consideration of the present invention is to provide a glue gun feeding mechanism of the general character described employing a rack and pinion between a trigger and a glue stick and which produces multiple gripping engagement elements for forcing the glue stick into a heating element.

Yet another feature of the present invention is to provide a glue gun of the general character described which minimizes the possibility of operator injury.

Other considerations, aspects and features of the present invention in part will be obvious and in part will be pointed out hereinafter.

With these ends in view, the invention find embodiment in the various combinations of elements and arrangements of parts by which the said features, aspects and considerations and certain other features, aspects and considerations are hereinafter attained all as more fully described with reference to the accompanying drawings and the scope of which is more particularly pointed and indicated in the appended claims.

BRIEF DESCRIPTION OF THE DRAWINGS

In the accompanying drawings in which is shown one of the various possible exemplary embodiments of the invention.

DESCRIPTION OF THE PREFERRED EMBODIMENT

Figure 1:
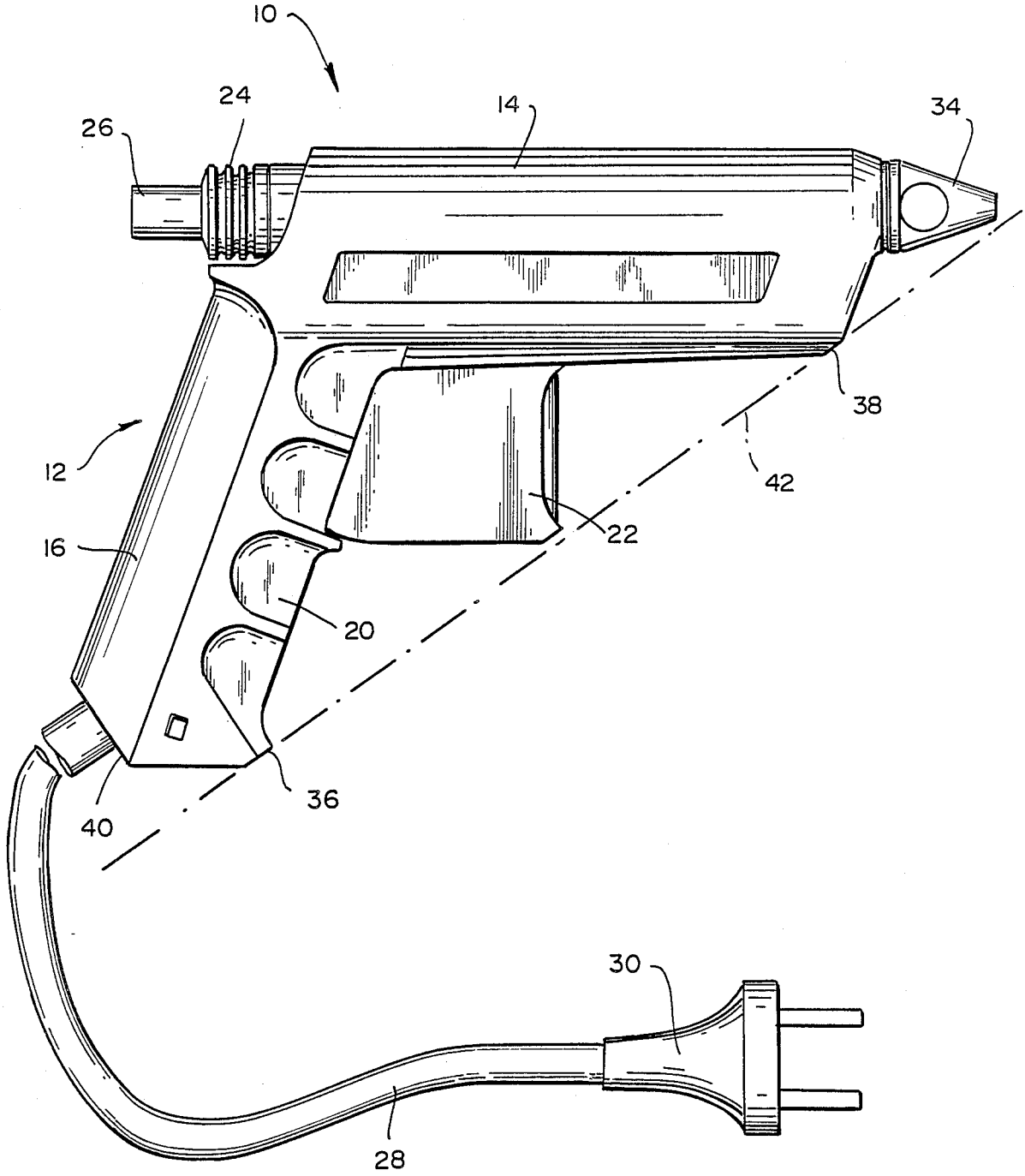
FIG. 1 is a front elevational view of a glue gun constructed in accordance with and embodying the invention.

Pursuant to the invention, an improved glue gun is provided with a glue stick feeder system wherein a pinion having rim teeth is utilized as the glue stick engaging feed element. The pinion rim teeth engage the surface of the glue stick while diametrically opposed pinion teeth mesh with a gear rack provided on the upper surface of a trigger. The invention thus provides a relatively simple two component feed system comprising the pinion and trigger rack as the sole driving elements apart from a return spring and associated bearing components in a casing.

When the pinion is driven by the trigger rack, a relatively long glue stick feed advance into a heating element is provided, equivalent to the trigger stroke length. Thus, with a trigger stroke of approximately 2½ inches (65 mm) a glue stick advance of 2½ inches (65 mm) can be achieved. With a relatively narrow extrusion nozzle on the glue gun, an uninterrupted sealing bead or line of up to a length as long as one and one half feed (½ meter) can be attained.

By utilizing the rack and pinion feed system of the invention, rather than individual claw or lever systems of the past, successive pinion teeth engage the glue stick surface with uniformity along a complete trigger stroke length thereby insuring reliable operation and safety without being impaled in the glue stick.

In addition, the glue gun includes a casing which supports the trigger for tilting movement as well as translational movement through an axis parallel to the glue stick feed axis. Such arrangement permits displacements of the trigger parallel to the feed axis for rotating the pinion and also permits simultaneous tilting of the trigger in a direction towards the glue stick feed axis for increasing the radial engagement force of the pinion teeth against the glue stick. This structure is of particular advantage when feeding glue sticks of relatively hard material where higher radial force components are required to prevent slippage and assure positive glue stick advancement.

In order to provide for translational displacement of the trigger parallel to the feed axis of the glue stick and the tilting of the trigger, the glue gun casing includes a horizontal channel which receives a pivot post projecting from the forward tip of the trigger.

With gear rack being configured on the upper surface of a trigger having a relatively large finger gripping surface, such as to accommodate at least two fingers, rack movement substantially parallel to glue stick axis is provided by uniform pressure of all operating fingers against the trigger. Should high pinion radial force components be required to advance a hard surface glue stick, the user need only exert more pressure with his/her lowermost fingers. This results in upward tilting of the trigger about the post and upward movement of the pinion to provide more feed force.

Various configurations may be provided for mounting the pinion in the glue gun casing and facilitating displacement of the pinion toward and away from the glue stick. For example vertical channels may be formed in the interior of the glue gun casing or, alternatively, a slotted hole may be provided in casing components on opposite sides of the pinion.

It has been found that improved operation is provided when the teeth of both the pinion and the rack are formed with rows of teeth. A trough is thus provided between the split teeth with a portion of the cylindrical glue stick surface projecting into the trough. Upon driving engagement between the pinion and the glue stick, tooth edges which define the trough penetrate into the glue stick surface in a relatively symmetrical pattern. Such double sided engagement has been found to be highly reliable and has provided balanced glue stick feed forces which are independent of the hardness of the glue stick material.

Alternate arrangements may include roughened surfaces of the pinion rim gear teeth, catch plates, or multiple enclosing troughs for optimizing feed engagement. Further, operation with a single row of pinion rim teeth has been achieved with satisfactory results.

Referring now in detail to the drawings, the reference numeral 10 denotes generally an improved glue gun constructed in accordance with and embodying the invention. The glue gun 10 includes a casing 12 in the overall configuration of a pistol and having a barrel 14, and a handle 16 with a plurality of finger accommodating recesses 20. A trigger 22 is mounted within the casing 12, extending downwardly from the barrel 14 and forwardly of the handle 16.

Mounted at the mouth of the breech of the barrel 14 is a cylindrical inlet tube 24 formed of silicone rubber. The tube 24 is coaxial with a feed path axis for glue sticks 26. An electric line cord 28 extends from a plug 30 into the glue gun 10 through a suitable aperture adjacent the bottom of the handle 16. At the muzzle of the barrel 14 is an extrusion nozzle 32 which is covered with a heat insulative silicone rubber sheath 34.

The casing 12 is so configured that the glue gun 10 may be placed on a horizontal support surface without contact between the nozzle and the support surface and without resting the side walls of the casing 12 on the support surface. With side walls of the casing exposed, optimum cooling ventilation of the glue gun is provided to prevent excessive heating and to permit air flow through ventilation apertures if provided in the casing side walls.

For such purpose, coplanar flat feet 36 and 38 are provided at an acute angle on the lowermost forward areas of the handle 16 and the barrel 14 respectively. The flat feet 36, 38 provide two point support the glue gun 10 when resting upon a horizontal surface. The common plane of the flat feet 36, 38 is designated, in FIG. 1, by a dot and dash line 42.

The glue gun is configured so that no part of the trigger lies in the plane 42. Thus, the trigger will not bear against the surface upon which the glue gun rests so as not to continue any glue stick advancement force. Also, the line cord 28 projects from a handle surface 40 which is substantially normal to the support plane upon which the glue gun rests so as not to generate any tipping moments.

The casing 12 itself is formed of two mating shell like sections 44, 46 which include overlapping peripheral lips and are adapted for simple snap together assembly.

Figure 2:
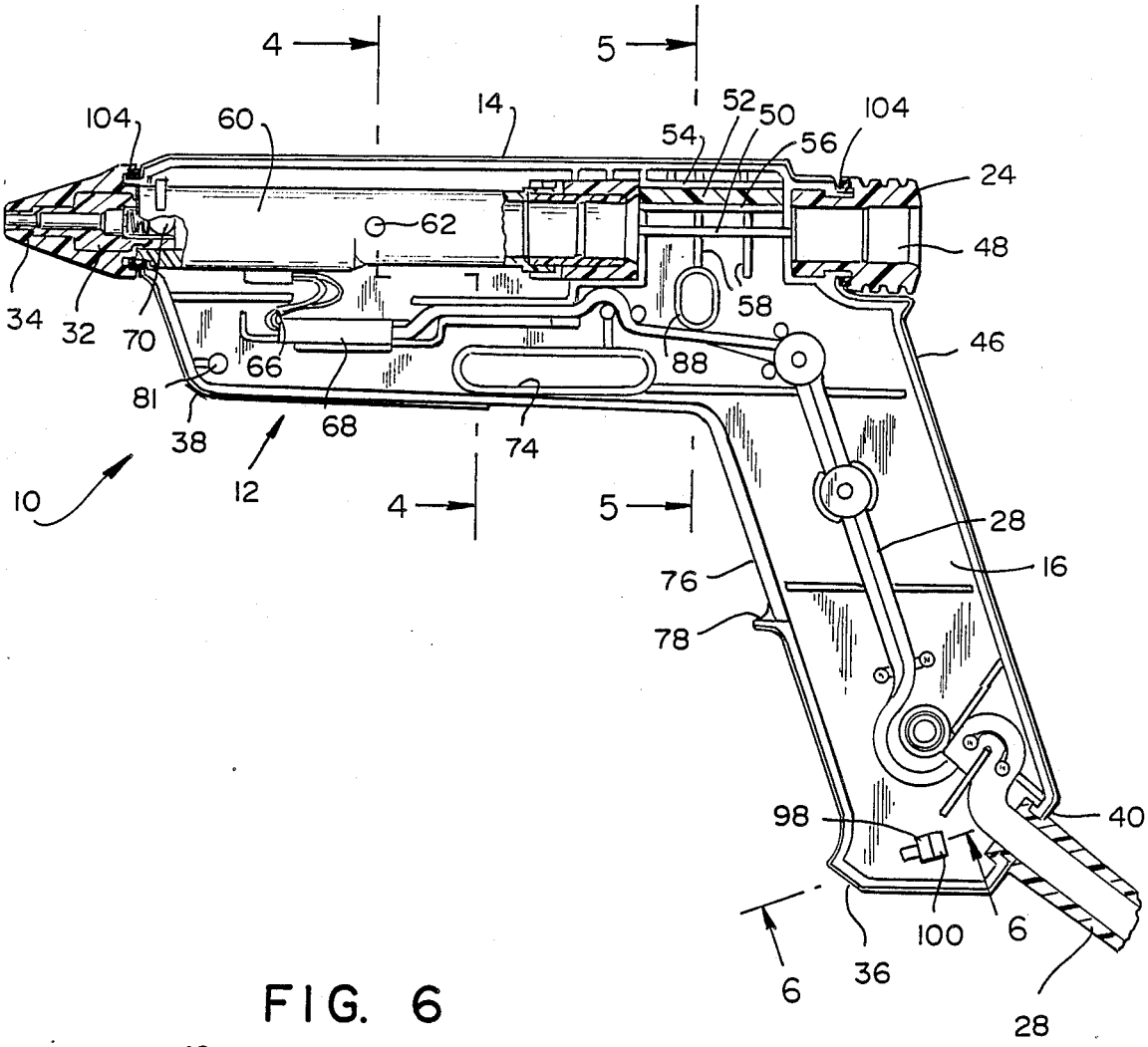
FIG. 2 is a view of the interior of the glue gun with one-half of its casing removed and with some of the components shown in partial axial section and other components deleted for clarity.
Figure 6:
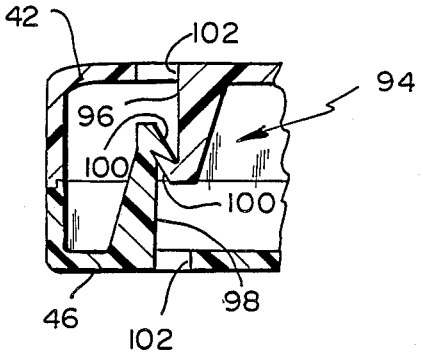
FIG. 6 is an enlarged scale fragmentary sectional view through the assembled glue gun, the same being taken substantially along the line 6—6 of FIG. 2 and showing a rapid assembly snap closure for the casing sections.
Figure 3:
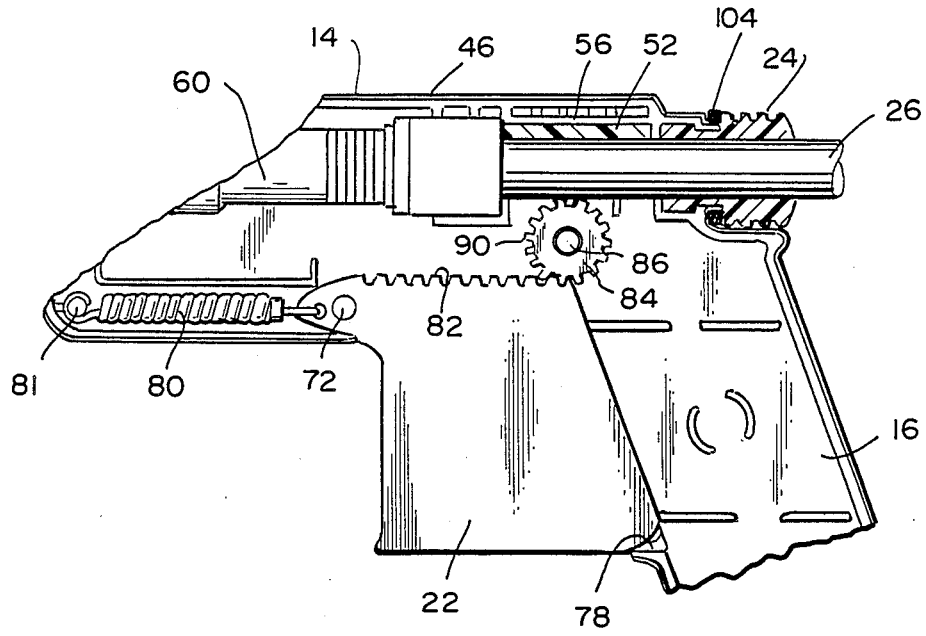
FIG. 3 is a fragmentary view of the glue gun, similar to the view of FIG. 2, but with a glue stick positioned in the gun and also showing a glue stick feeding system constructed in accordance with the present invention and including a pinion engaging the glue stick and being drivable by a rack on an upper surface of a trigger.
Figure 5:
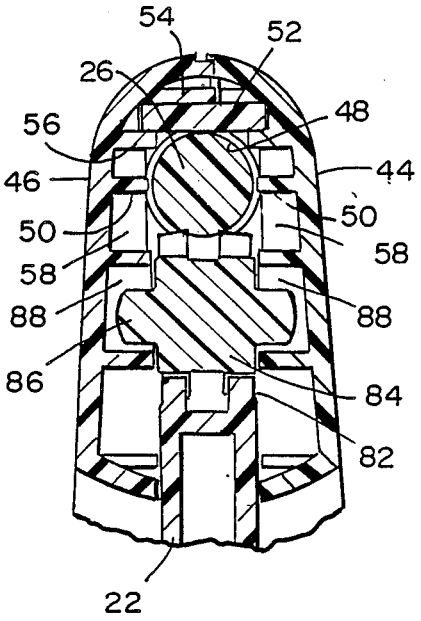
FIG. 5 is a further enlarged scale sectional view through the fully assembled glue gun, the same being taken substantially along the line 5—5 of FIG. 2 and showing the pinion drivingly engaging a glue stick.

A glue stick inlet bore 48, illustrated in FIGS. 2 and 5, extends from the inlet tube 24 through the barrel 14. Adjacent the tube 24, the bore 48 is formed by a flange grid comprising a pair of opposed horizontal path defining flanges 50 which extend inwardly from the outer surface of each casing section and a plurality of vertical webs 58. In addition, an upper bearing plate 52, formed of polytetrafluoroethylene or a like substance is provided. The bearing plate 52 is seated between pairs of parallel flanges 54, 56. As will be observed from FIGS. 3 and 5, the upper surface of a glue stick 26 bears against the plate 52 under the pressure of the feeding system of the invention.

The glue gun 10 also includes a heating assembly 60 having an upstream glue stick guiding section and a downstream heating channel. A PTC (positive temperature coefficient) heater/projects into the heating channel and provides both heat and thermostatic temperature control. The heating assembly 60 is mounted within the barrel through a pair of transversely projecting posts 62 which extend into mating sockets 64 formed on the interior surface of the casing sections.

Electric current is provided for the PTC heater through the line cord 28 which extends from the aperture in the handle surface 40, upwardly within the handle 16 and forwardly within the barrel. The line cord is passed repeatedly around a plurality of integral baffle plates and posts which serve to position and fix the line cord at several points along its path. The ends of the line cord are joined to lead wires 66 of the PTC heater at a connector 68.

The heating assembly 60 includes a return valve 70 which extends into the heating channel. The valve includes a spring loaded ball which prevents molten thermoplastic from flowing out of the heating chamber except when pressurized by actuation of the trigger 18. The valve thus prevents oozing of adhesive from the nozzle 32.

It should be noted that the trigger 22 is mounted to the gun 10 for sliding movement toward the handle 16 when force is exerted by the user's fingers. Such movement is basically along a plane parallel to the glue stick feed axis. In addition to such translational movement, the trigger is pivotable for counter clockwise rotation (as viewed from FIG. 3) about a pivot pin 72. The pin 72 may be unitarily molded as an integral part of the trigger and the trigger itself may include hollow interior sections for reducing weight and material costs. Alternately, the pin 72 may be formed as a separate component.

The trigger motion is guided by a pair of facing horizontal channels 74 which project from the casing sections 44, 46. An opening 76 is provided in the handle 16 to accommodate the trigger 22. The lower edge of such opening includes an abutment shelf 78 which functions as a guide for trigger movement. After the trigger has been squeezed and moved inwardly toward the handle 16, release of finger pressure will result in the trigger returning to its original position due to a helical coil spring 80 which extends between a post 81 formed in the casing and an aperture formed in the forward tip of the trigger 22.

In accordance with the invention, a horizontal upper surface of the trigger 22 is formed with an integral rack gearing 82. The rack may be designed as a separate component fixed to the trigger, however, integral molding of the rack and trigger simplifies the number of components and thereby provides cost reduction. The rack gearing 82 engages a pinion 84 in order to exert feeding force on the glue stick 26. The pinion 84 is itself mounted for rotation through an integral shaft 86 which is mounted within a pair of opposed vertical channels 88 formed in the casing sections 44, 46.

The channels 88 prevent translational movement of the pinion 84 in a direction parallel to the glue stick feed axis yet permit movement in a plane perpendicular to such axis for the purpose of increasing the engagement forces between the pinion and a glue stick. As will be observed from FIG. 3, the rim teeth of the pinion 84 engage and are driven by the rack teeth 82 and, diametrically opposed teeth are in engagement with the surface of glue stick 26. By gripping and pulling on the trigger, an operator will cause the trigger to translate into the handle 16, (toward the right as viewed in FIG. 3), causing the pinion 84 to rotate in a counter clockwise direction.

Successive pinion rim teeth diametrically opposed to the teeth in engagement with the rack 82 will bite into and force the glue stick 26 downstream, toward the heater assembly 60. During such translational movement of the trigger 22, the trigger pin 72 slides within the horizontal channels 74.

The driving engagement between the pinion teeth and the glue stick may be fictional where minimum advancement force is required. For increased forces, interference between the glue stick and the pinion teeth is desired and will result in the pinion teeth deforming the glue stick surface to generate at least a partial corresponding gear rack.

As previously mentioned, should increased glue stick advancement force be required, the trigger 22 may be pivoted in a counter clockwise direction, (as viewed from FIG. 3) about the pin 72. Such pivoting moment can be easily effected by increasing the pressure applied with the lowermost trigger gripping finger. The increased force results in a radial force transfer through the pinion rim teeth so that the pinion teeth will exert greater radial biting force against the surface of the glue stick 26. The rim teeth radial force causes the glue stick to bear against the bearing plate 52 which, as previously mentioned, is formed of a material having sufficient lubricity such as polytetrafluoroethylene. Any necessary motion of the pinion in a vertical direction toward the glue stick to provide increased penetration of the pinion teeth into the glue stick is permitted by the vertical channels 88.

With attention now directed to FIG. 5, it should be observed that the pinion 84 may be provided with split rows of teeth, that is over the width of the pinion, each individual spur tooth 90 may be split at its center to provide a central trough 92 between the two rows of teeth. A chordal segment of the glue stick periphery extends into the trough 92.

The opposed, interior facing corners of the top tooth lands at the trough 92 are adapted to engage and penetrate the glue stick surface in a symetrical array, forcing the glue stick to advance to the heating assembly 60.

Figure 4:
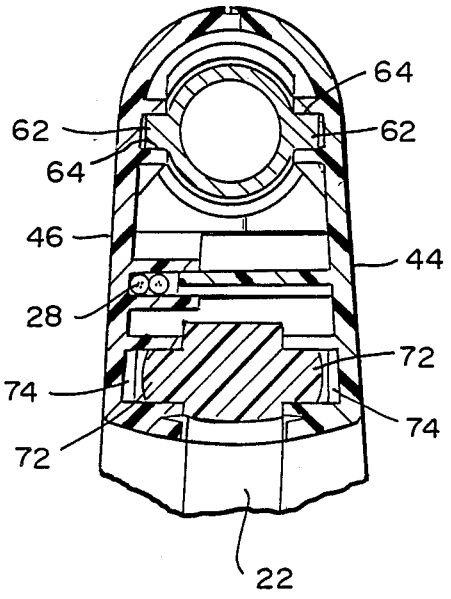
FIG. 4 is an enlarged scale sectional view through the glue gun, the same being taken substantially along the line 4—4 of FIG. 2 with the gun fully assembled, and illustrating a heating element, electrical feed lines contained within a channel, and a pivot pin of the trigger in engagement with a horizontal channel.

As will be observed in FIG. 5, the mating teeth of the rack 82 can also be formed as split teeth. As previously mentioned, the line cord 28 is routed within the gun 10 around a plurality of baffles which securely position the line cord. Referring now to FIG. 4, it will be seen that in the area adjacent the heating assembly 60, the line cord baffle system comprises a closed channel precisely fixing the position of the line cord so as to avoid inadvertent contact with the heating element 62.

In order to facilitate quick and simple production line assembly of the glue gun without the use of assembly screws, the components are inserted into one to the two casing sections, for example, the section 46, and the remaining section is registered with and pressed against the section carrying the components. An integral snap closure 94 is provided adjacent the bottom of the handle 16. The snap closure includes a pair of mating posts 96, 98.

Each post carries a fluke at its head with the fluke including a downwardly sloped surface 100. The sloped surfaces interengage each other as the two casing sections are pressed toward one another. As soon as the tips of the flukes pass one another, the posts spring together in an interlocking fashion. An access aperture 102 is provided in each of the casing sections in registry with the post for the purpose of disassembly.

To disassemble the casing, a tool, such as a screwdriver, is inserted into one of the apertures and force is applied to spread one post away from the other until the flukes disengage.

In addition to the snap closure 94, the casing sections are secured together at the opposite ends of the barrel 14 with an elastic or metal ring 104 which is forced over a cylindrical collar formed by the mating casing sections at each end of the barrel 14.

Thus it will be seen that there is provided a glue gun which achieves the various considerations, features and aspects of the present invention and which is well suited to meet the conditions of practical usage.

As various changes might be made in the glue gun as above said forth, it is to be understood that all matter herein described or shown in the accompanying drawings is to be interrupted as illustrative and not in a limiting sense.

Having thus described the invention, there is claimed as new and desired to be secured by Letters Patent:

1. A glue gun feeding system for advancing cylindrical glue sticks in a glue gun, the glue gun including means forming a glue stick feed path and an electric heating assembly, the glue stick feeding system including a pinion, means journalling the pinion for rotation about an axis perpendicular to the feed path axis, the means for journalling the pinion including means for preventing translational movement of the pinion in a direction parallel to the feed path axis and for permitting movement of the pinion perpendicular to the feed path axis, the pinion having rim teeth, means for providing interengagement between the rim teeth and a glue stick in the feed path and gearing means for driving the pinion to advance the glue stick toward the heating assembly, the means for driving the pinion including a finger actuated element, a gear rack associated with the finger actuated element, the gearing means being in driving engagement with the pinion, and means for guiding the rack for movement in a direction substantially parallel to the feed path axis and permitting movement of the rack toward the feed path axis, whereby when the finger actauted element is engaged, the gear rack will drive the pinion to advance the glue stick and radial presssure of the rim teeth can be increased.

2. A glue gun feeding system constructed in accordance with claim 1 wherein the finger actuated element comprises a gun trigger and the rack is formed unitarily with the trigger.

3. A glue stick feeding system constructed in accordance with claim 1 wherein the means for guiding the rack includes means forming a channel in the glue gun and means forming a pin adjacent one end of the rack, the pin being slidable within the channel for movement of the rack in a direction substantially parallel to the feed path axis and the rack being pivotable about the pin for providing movement of the rack toward the glue stick feed path axis.

4. A glue gun adapted to receive thermoplastic sticks and extrude molten thermoplastic, the glue gun comprising a glue stick feed path, a heating assembly in the feed path and a glue stick feeding system for advancing a glue stick in the feed path toward the heating assembly, the feeding system including a trigger, a pinion having rim teeth, the rim teeth being engagable with the surface of a glue stick positioned in the feed path, gearing means including a rack drivingly engaging the pinion, means interconnecting the rack and the trigger for unitary displacement and means mounting the trigger for displacement in a direction substantially parallel to the feed path axis while permitting tilting movement of the trigger toward the feed path axis.

5. A glue gun constructed in accordance with claim 4 wherein the means mounting the trigger includes a pin projecting from the trigger and a channel in the glue gun, the pin being positioned in the channel.

6. A glue gun constructed in accordance with claim 4 wherein the rack is positioned on the upper surface of the trigger.

7. A glue gun constructed in accordance with claim 6 wherein the trigger includes a finger gripping surface, the finger gripping surface being positioned substantially perpendicular to the rack.

8. A glue gun constructed in accordance with claim 6 wherein the rack is constructed as an integral part of the trigger.

9. A glue gun constructed in accordance with claim 4 further including means mounting the pinion for displacement along a plane perpendicular the glue stick feed path axis.

10. A glue gun constructed in accordance with claim 9 wherein the means mounting the pinion includes guide means extending perpendicular to the glue stick feed path axis, the pinion including a shaft, the shaft being positioned within the guide means.

11. A glue gun constructed in accordance with claim 10 wherein the guide means comprises a channel formed as an integral part of the glue gun.

12. A glue gun constructed in accordance with claim 4 wherein the pinion rim teeth comprise two rows of teeth separated by a trough.

13. A glue gun adapted to receive thermoplastic sticks and extrude molten thermoplastic, the glue gun comprising a glue stick feed path, the feed path including an upper fixed friction reducing bearing, a heating assembly in the feed path and a glue stick feeding system for advancing a glue stick in the feed path toward the heating assembly, the feeding system including a trigger, a pinion having two rows of rim teeth separated by a trough, a glue stick being positioned between the pinion and the bearing, a chordal segment of the glue stick positioned in the feed path extending into the trough, facing corners of the rim teeth defining the upper ends of the trough, the facing corners being engagable with the chordal surface of the glue stick, gearing means including a rack, the gearing means drivingly engaging the pinion and means interconnecting the rack and the trigger for unitary displacement.

* * * * *